US006448993B1

(12) United States Patent
Hayashi et al.

(10) Patent No.: US 6,448,993 B1
(45) Date of Patent: Sep. 10, 2002

(54) CONSTRUCTION OF THERMAL PRINT HEAD AND METHOD OF FORMING PROTECTIVE COATING

(75) Inventors: Hiroaki Hayashi; Eiji Yokoyama; Takumi Yamade, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/462,022

(22) PCT Filed: Jul. 22, 1998

(86) PCT No.: PCT/JP98/03286

§ 371 (c)(1),
(2), (4) Date: Dec. 30, 1999

(87) PCT Pub. No.: WO99/04980

PCT Pub. Date: Feb. 4, 1999

(30) Foreign Application Priority Data

Jul. 22, 1997 (JP) ..... 9-195967
Jul. 22, 1997 (JP) ..... 9-195968

(51) Int. Cl.[7] ..... B41J 2/335
(52) U.S. Cl. ..... 347/203
(58) Field of Search ..... 347/63, 64, 57–59, 347/200, 203; B41J 2/335

(56) References Cited

FOREIGN PATENT DOCUMENTS

| | | | | |
|---|---|---|---|---|
| JP | 61154954 | | 7/1986 | |
| JP | 63141764 | | 6/1988 | |
| JP | 4-91960 | A * | 8/1990 | ..... B41J/2/335 |
| JP | 2-238956 | | 9/1990 | |
| JP | 2-263661 | | 10/1990 | |
| JP | 04007161 | | 1/1992 | |
| JP | 4-91960 | | 3/1992 | |
| JP | 4-112048 | | 4/1992 | |
| JP | 4-112050 | A * | 4/1992 | ..... B41J/2/345 |
| JP | 06008501 | A * | 6/1992 | ..... B41J/2/335 |
| JP | 4-214367 | | 8/1992 | |
| JP | 6-8501 | | 1/1994 | |
| JP | 7-266594 | | 10/1995 | |
| JP | 4-79646 | | 7/1996 | |

OTHER PUBLICATIONS

Supplemental European Search Report, Jan. 17, 2001.

* cited by examiner

*Primary Examiner*—N. Le
*Assistant Examiner*—K. Feggins
(74) *Attorney, Agent, or Firm*—Merchant & Gould P.C.

(57) ABSTRACT

A thermal printhead includes a head substrate (1), a heating resistor (5) provided on the head substrate, a plurality of individual electrodes (2) connected to the heating resistor, and a common electrode (3) connected to the heating resistor. The thermal printhead is further provided with a first coating layer (6) covering the heating resistor, the individual electrodes and the common electrode, and a second coating layer (7) which is formed on the first coating layer and made of sialon containing a conductive material as an additive. The first coating layer is formed with at least one through-hole (6*a*) or notch (6*a*'), so that the second coating layer is electrically connected to the common electrode via the through-hole or the notch.

3 Claims, 3 Drawing Sheets

CONSTRUCTION OF THERMAL PRINT HEAD AND METHOD OF FORMING PROTECTIVE COATING

TECHNICAL FIELD

The present invention relates to the structure of a thermal printhead for use in e.g. a facsimile machine to perform printing. Further, the present invention relates to a method of forming a protective coating in such a thermal printhead.

BACKGROUND ART

Generally, a thermal printhead includes a head substrate as a support member. The upper surface of the head substrate is provided with a plurality of drive ICs, a predetermined wiring pattern and a linear heating resistor. The wiring pattern includes a plurality of individual electrodes respectively connected to the drive ICs and a common electrode which has a plurality of comb-tooth projections (each hereinafter referred to as a "tooth"). The individual electrodes extend in parallel to each other. Each tooth of the common electrode extends into a space between two adjacent individual electrodes. Thus, the individual electrodes and the teeth are alternately disposed. The heating resistor extends across the individual electrodes and the teeth. The upper surface of the head substrate is further formed with a protective coating for covering the individual electrodes, the common electrode and the heating resistor.

Conventionally, such a protective coating is made by a thick film technique using a glass material which is excellent in abrasion resistance and electric insulation. (The thick film technique is a method comprising the steps of applying a paste material onto the head substrate by screen printing, and thereafter drying and baking the applied material.) However, this kind of protective coating has the following problems. The protective glass coating generates static electricity due to friction with a recording paper. As a result, the protective coating is likely to be electrostatically charged. Thus, due to an electrostatic discharge, the heating resistor and the wiring pattern may be electrostatically damaged.

To avoid such an electrostatic discharge, a two-layer protective coating has been recently proposed. Specifically, the protective coating includes a first coating layer formed of e.g. glass on a top surface of the head substrate by a thick film technique, and a second coating layer formed on the first coating layer by a thin film technique such as spattering. The second coating layer is made of sialon having a good abrasion resistance. The sialon contains an appropriate amount of an electrically conductive material such as titanium nitride as an additive to decrease the electrically insulating ability of the second coating layer. As a result, the second coating layer becomes less likely to be electrostatically charged.

It is true that the addition of such a conductive material makes the second coating layer less likely to be electrostatically charged. However, an electrostatic charge gradually builds up in the second coating layer. As a result, an electrostatic discharge eventually occurs between the second coating layer and the heating resistor or the wiring pattern. Thus, the addition of an electrically conductive material does not completely prevent the second coating layer from being electrostatically damaged.

The two-layer protective coating has other problems. As described above, the second coating layer is formed by spattering, specifically in the following manner. First, a head substrate formed with a first coating layer is placed in a closed chamber. Then, a target made of sialon containing an appropriate proportion of titanium nitride is disposed in facing relation to the first coating layer. Finally, a target voltage is applied across the target and the head substrate.

Conventionally, the proportion of titanium nitride to sialon is 50 wt % for example. However, this results in an excessive increase of the conductivity of the second coating layer. Thus, when a voltage is applied to the heating resistor to perform printing, a considerable voltage may be applied to the second coating layer, which may cause melting of the second coating layer.

Accordingly, to prevent such melting of the second coating layer during the printing operation, the surface electrical resistance of the second coating layer needs to be increased to such a degree that may prevent charging of the second coating layer.

To increase the surface electrical resistance of the second coating layer, the proportion of titanium nitride in sialon needs to be decreased. For this purpose, spattering should be performed using a target which includes no more than 20 wt % of titanium nitride. However, when spattering is performed using such a target containing no more than 20 wt % of titanium nitride, the weight percentage of titanium nitride in the resulting second coating layer fluctuates largely. Accordingly, it is impossible to provide a second coating layer having a stable titanium nitride-sialon composition.

Conventionally, therefore, at least 25% of titanium nitride is added to sialon. In such a case, however, the surface electrical resistance of the second coating layer cannot be increased above $10^4$ Ω·cm. As a result, it is impossible to reliably prevent melting of the second coating layer when a voltage is applied to the heating resistor.

DISCLOSURE OF THE INVENTION

It is an object of the present invention to provide a thermal printhead which is capable of solving the above-described problems.

It is another object of the present invention to provide a method of forming a protective coating which is capable of solving the above-described problems.

In accordance with a first aspect of the present invention, there is provided a thermal printhead comprising:

- a head substrate;
- a heating resistor provided on the head substrate;
- a plurality of individual electrodes connected to the heating resistor;
- a common electrode connected to the heating resistor;
- a first coating layer covering the heating resistor, the individual electrodes and the common electrode;
- a second coating layer formed on the first coating layer, the second coating layer comprising sialon which contains a conductive material as an additive;
  characterized that the second coating layer is electrically connected to the common electrode.

With this arrangement, the second coating layer, which comprises sialon containing a conductive material as an additive, is electrically connected to the common electrode. Accordingly, even if the second coating layer is electrostatically charged due to friction with a recording paper, the static electricity escapes to the common electrode. Thus, it is possible to prevent static buildup in the second coating layer, thereby reliably preventing the heating resistor and the individual electrodes from being electrostatically damaged due to discharge of the static charge.

Preferably, the first coating layer may be formed with at least one through-hole or notch, whereby the second coating layer is electrically connected to the common electrode via the through-hole or the notch.

With this arrangement, the provision of the through-hole or the notch facilitates electrically connecting the second coating layer to the common electrode located below the first coating layer. As a result, it is possible to advantageously reduce the labor and hence the cost required for the electrical connection.

In accordance with a second aspect of the present invention, there is provided a method of forming a protective coating comprising the steps of:

forming a first coating layer on a head substrate provided with a heating resistor and a wiring pattern for covering the heating resistor and the wiring pattern; and forming a second coating layer on the first coating layer by spattering sialon containing titanium nitride as an additive;

characterized that the spattering is performed in a nitrogen-gas-containing atmosphere.

Preferably, the spattering may be performed using a target which is made of sialon containing 25 to 40 wt % of titanium nitride, and the atmosphere may contain 10 to 40 volume % of nitrogen gas.

With the above method, the spattering is performed in a nitrogen-gas-containing atmosphere. Accordingly, the use of a target made of sialon containing a relatively large proportion of titanium nitride allows formation of a second coating layer containing a relatively low proportion of titanium nitride (and hence having a relatively large surface electrical resistance) with a stable composition.

Specifically, when the spattering is performed in an atmosphere containing 10 to 40 volume % of nitrogen gas with the use of a target made of sialon containing 25 to 40 wt % of titanium nitride, the surface resistance of the resulting second coating layer lies in the range of from $10^5$ Ω·cm to $10^8$ Ω·cm (see FIG. 5). It is possible to effectively prevent the heating resistor, the individual electrodes and the like from being electrostatically damaged while also preventing melting of the second coating layer.

Various features and advantages of the present invention will become clearer from the description given below with reference to the accompanying drawings.

BEST MODE FOR CARRYING OUT THE INVENTION

A preferred embodiment of the present invention will be described below in detail with reference to the accompanying drawings.

Figure 1:
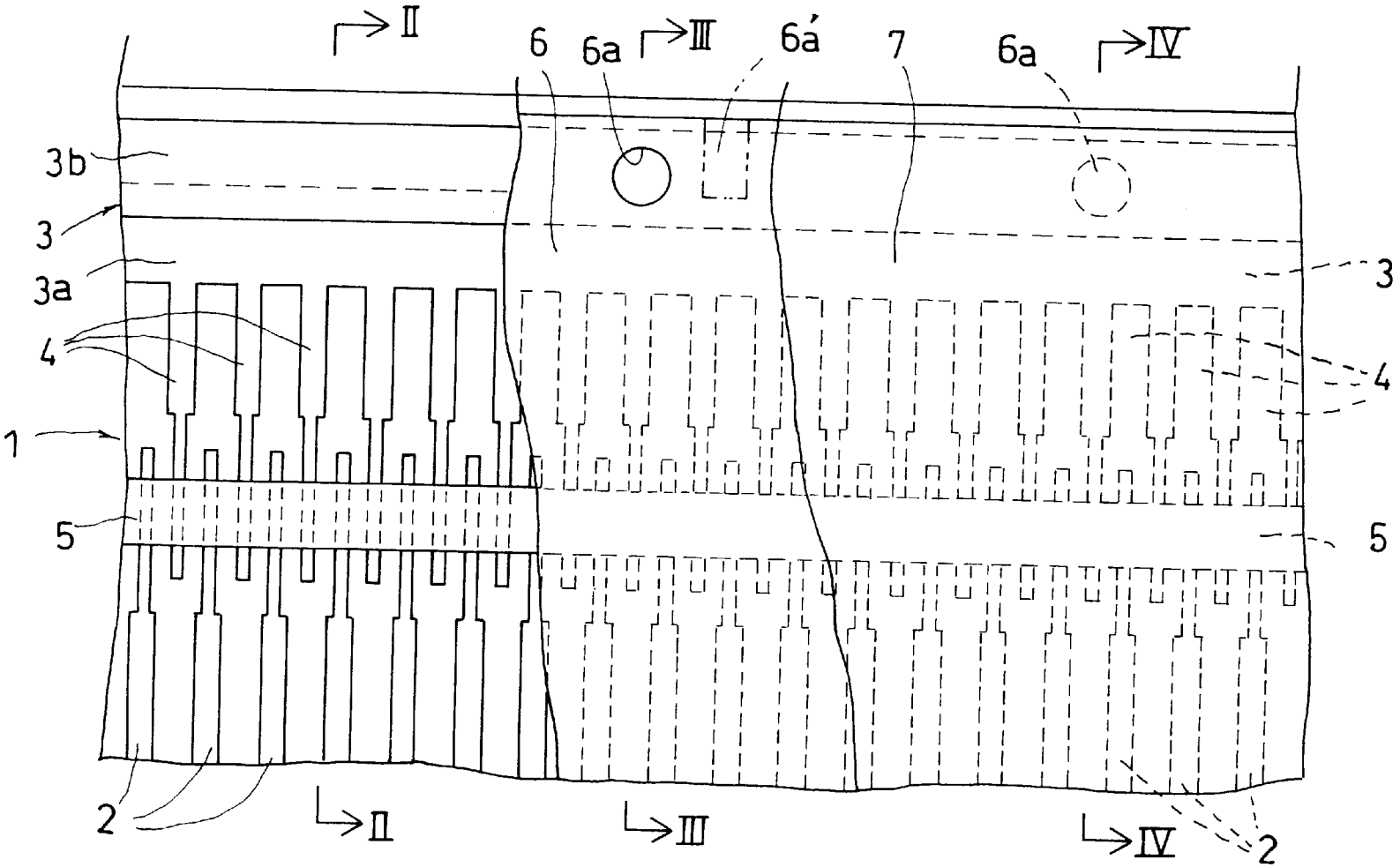
FIG. 1 is an enlarged plan view showing a principal portion of a thick film thermal printhead.

Referring to FIG. 1, indicated by reference character 1 is a head substrate in a thick film-type thermal printhead. The upper surface of the head substrate 1 is provided with a plurality of individual electrodes 2 connected to drive ICs (not shown), and a common electrode 3. The common electrode 3 includes a plurality of comb-tooth projections 4 (each hereinafter referred to as a "tooth"). The individual electrodes 2 extend in parallel to each other. Each tooth 4 of the common electrode extends into a space between two adjacent individual electrodes 2. Thus, the individual electrodes 2 and the teeth 4 are alternately disposed. The upper surface of the head substrate 1 is further provided with a thick film linear heating resistor 5. As shown in the drawings, the heating resistor 5 extends across the individual electrodes 2 and the teeth 4.

Figure 2:
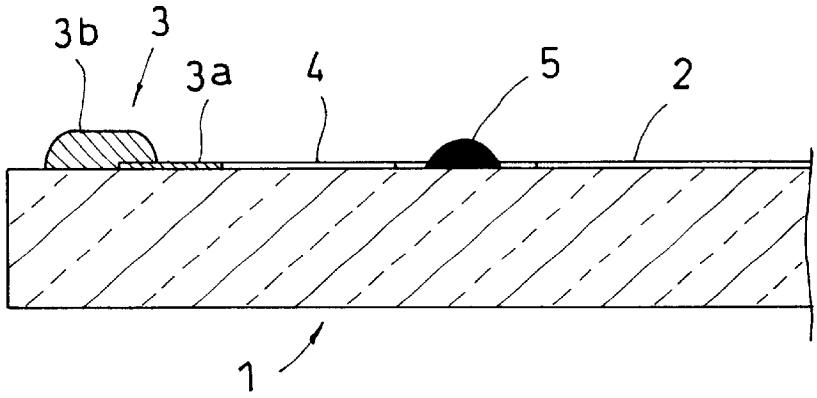
FIG. 2 is a sectional view taken on lines II—II in FIG. 1.

The individual electrodes 2 and the teeth 4 are formed of a thin gold film. As clearly shown in e.g. FIG. 2, the common electrode 3 comprises a lower layer 3*a* which is formed of a thin gold film to have integral teeth 4, and an upper layer 3*b* formed of silver for partially covering the lower layer 3*a*.

Figure 3:
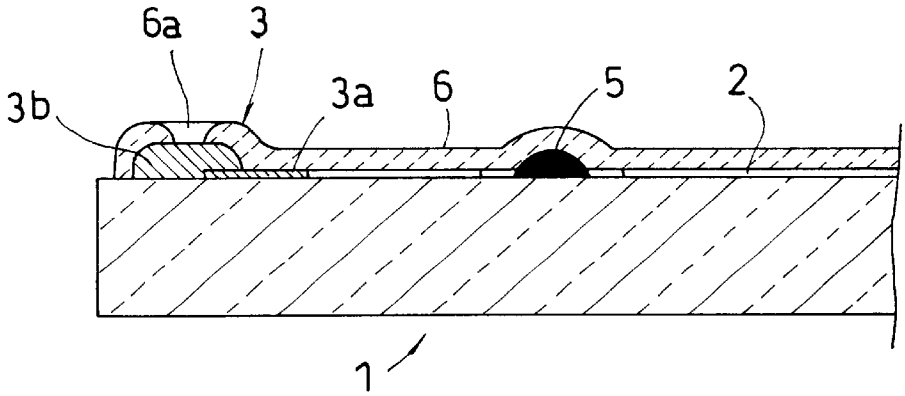
FIG. 3 is a sectional view taken on lines III—III in FIG. 1.

Indicated by reference character 6 is a first coating layer formed of e.g. glass. The first coating layer 6 is formed on the upper surface of the head substrate 1 for covering the individual electrodes 2, the common electrode 3 and the heating resistor 5. As shown in FIGS. 1 and 3, the first coating layer 6 is provided with a plurality of through-holes 6a at positions corresponding to the common electrode 3. The through-holes 6*a* are arranged at predetermined intervals longitudinally of the heating resistor 5.

The first coating layer 6 is formed by a thick film technique which comprises the steps of applying a paste material onto the head substrate 1 by screen printing, and then drying and baking the paste material. At this time, the paste material is not applied to the portions which later provide the through-holes 6*a*.

Indicated by reference character 7 is a second coating layer formed of sialon to which is added an electrically conductive material such as titanium nitride. The second coating layer 7 is provided on the first coating layer 6 by a thin film technique such as spattering (see FIG. 4).

Specifically, spattering is performed as follows. First, the head substrate 1 previously formed with the first coating layer 6 is put into a closed chamber hermetically loaded with nitrogen gas. Then, a target made of sialon and containing a suitable proportion of titanium nitride as an additive is disposed in facing relation to the first coating layer 6. Finally, a target voltage is applied across the target and the head substrate 1.

Figure 4:
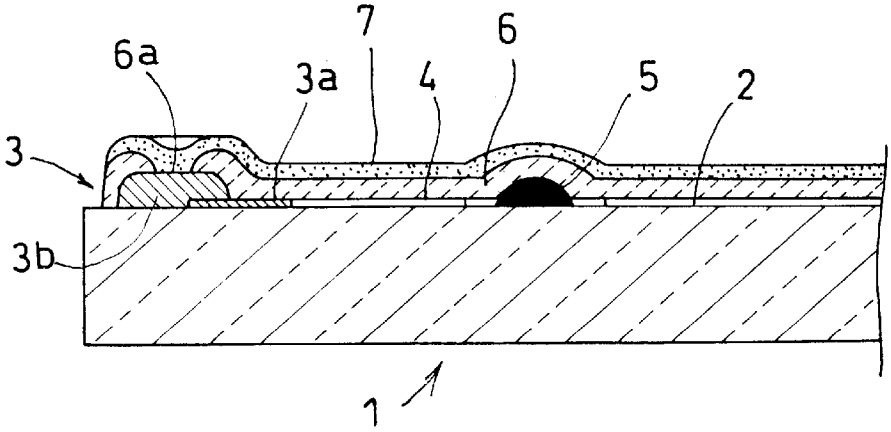
FIG. 4 is a sectional view taken on lines IV—IV in FIG. 1.

Thus, the second coating layer 7 is formed to cover the first coating layer 6. Accordingly, the through-holes 6*a* of the first coating layer 6 are also covered with the second coating layer 7. As a result, the second coating layer is electrically connected via the through-holes 6*a* to the common electrode 3 (to be more specific, the upper layer 3*b* of the common electrode 3), as shown in FIG. 4.

Accordingly, even if the second coating layer 7 is electrostatically charged due to friction with a recording paper, the static electricity escapes to the common electrode 3. In this way, it is possible to reliably prevent static buildup in the second coating layer 7.

In the embodiment described above, the second coating layer 7 is electrically connected to the common electrode 3 via the through-holes 6*a* of the first coating layer 6. However, the second coating layer 7 may be electrically connected to the common electrode 3 by other means. For example, instead of the through-holes 6*a*, a notch 6*a*' may be formed in the first coating layer 6, as indicated by chain lines in FIG. 1.

The through-holes 6*a* need not necessarily be arranged in parallel to the heating resistor 5, but may be provided at any positions corresponding to the common electrode 3. Further, only a single through-hole maybe provided instead of the plural through-holes shown in the drawings.

Figure 5:
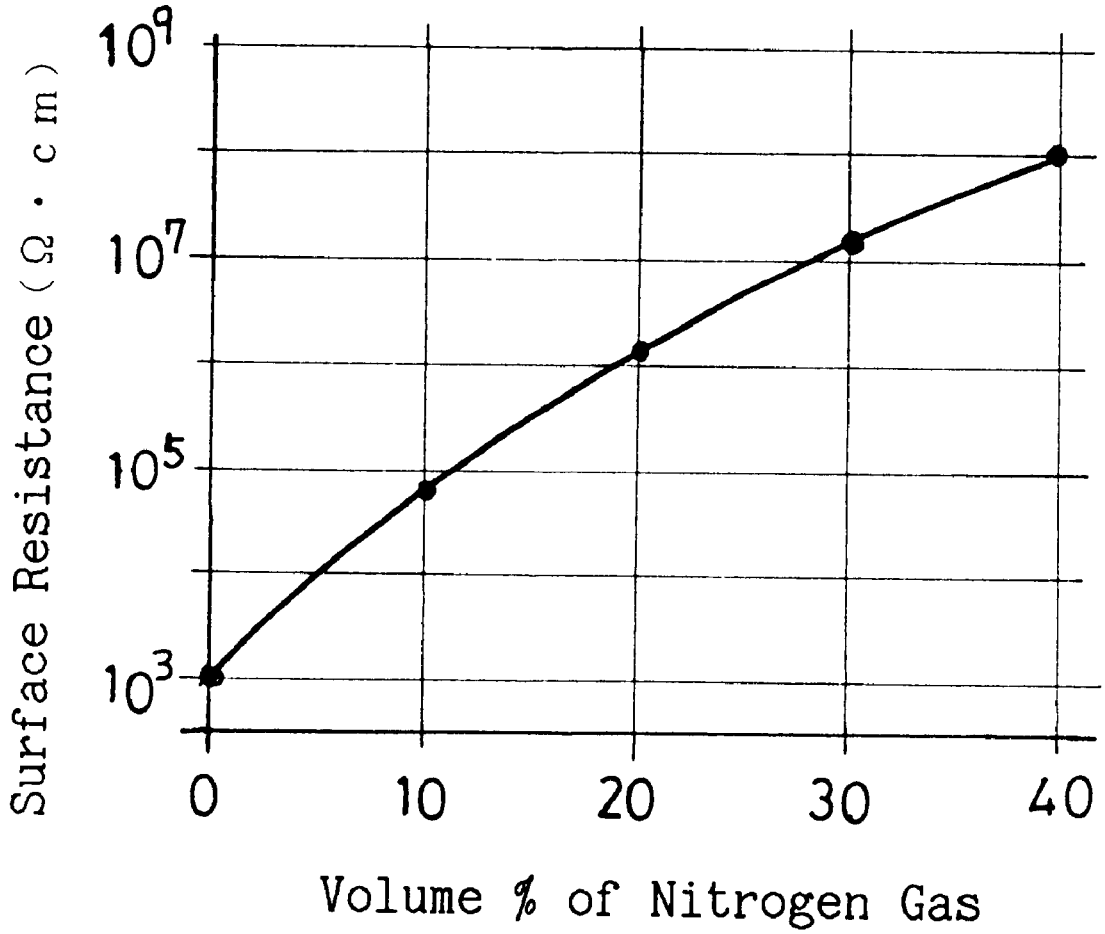
FIG. 5 is a graph showing the relationship between the nitrogen gas concentration and the surface electrical resistance of the second coating layer when the second coating layer is formed by spattering in a nitrogen-gas-containing atmosphere.

Now, reference is made to FIG. 5. The inventors have experimentally found the following facts. In forming the second coating layer 7, spattering was performed in an atmosphere which varied in nitrogen gas concentration from 10 to 40 volume %, using a target made of sialon and containing 25 to 40 wt % of titanium nitride as an additive. As a result, it was found that the surface electrical resistance of the second coating layer 7 can be held in the range of from $10^5$ Ω·cm to $10^8$ Ω·cm, as shown in FIG. 5. When the electrical surface resistance of the second coating layer 7 lies within this range, it is possible to reliably prevent the heating resistor 5, the individual electrodes 2 and the teeth 4 from being electrostatically damaged while also preventing the second coating layer 7 from melting.

If the surface electrical resistance of the second coating layer 7 is less than $10^5$ Ω·cm, the second coating layer 7 may melt during the printing due to the poor insulation of the second coating, layer 7. Conversely, if the electrical resistance is higher than $10^8$ Ω·cm, the heating resistor 5 or the like may be electrostatically damaged due to the excessively high insulation of the second coating layer 7. However, since the surface electrical resistance of the second coating layer 7 is in the range of $10^5$ Ω·cm to $10^8$ Ω·cm, it is possible to reliably prevent electrostatic damaging of the heating resistor 5 and melting of the second coating layer 7.

Although the present invention is applied to a thick film thermal printhead in the above embodiment, it is clear that the present invention may also be applied to a thin film thermal printhead.

What is claimed is:

1. A thermal printhead comprising:

a head substrate;

a heating resistor provided on the head substrate;

a plurality of individual electrodes connected to the heating resistor;

a common electrode including a first conductive layer connected to the heating resistor, and a second conductive layer formed on the first conductive layer and connected to the first conductive layer, the common electrode being separate from the individual electrodes, the second conductive layer having a smaller resistivity than the first conductive layer;

a first coating layer covering the heating resistor, the individual electrodes and the common electrode; and a second coating layer formed on the first coating layer, the second coating layer comprising sialon which contains a conductive material as an additive;

wherein the first coating layer is formed with at least one through-hole or notch;

wherein the second coating layer is electrically connected to the second conductive layer of the common electrode via the through-hole or the notch.

2. A method of forming a protective coating in a thermal printhead comprising the steps of:

forming a first coating layer on a head substrate provided with a heating resistor and a wiring pattern for covering the heating resistor and the wiring pattern; and forming a second coating layer on the first coating layer by spattering sialon which contains titanium nitride as an additive, wherein the spattering is performed in a nitrogen-gas-containing atmosphere.

3. The method of forming the protective coating according to claim 2, wherein the spattering is performed using a target which is made of sialon containing 25 to 40 wt % of titanium nitride, the atmosphere containing 10 to 40 volume % of nitrogen gas.

* * * * *